United States Patent [19]

Jansson

[11] 4,074,597

[45] Feb. 21, 1978

[54] PLIERS

[75] Inventor: Conny Erik Jansson, Enkoping, Sweden

[73] Assignee: AB Bahco Verktyg, Enkoping, Sweden

[21] Appl. No.: 746,080

[22] Filed: Nov. 30, 1976

[30] Foreign Application Priority Data

Dec. 19, 1975 Sweden ..... 7514465

[51] Int. Cl.[2] ..... B25B 7/02

[52] U.S. Cl. ..... 81/417; 30/261

[58] Field of Search ..... 81/417; 30/261, 212

[56] References Cited

U.S. PATENT DOCUMENTS

| | | | |
|---|---|---|---|
| 833,714 | 10/1906 | Goode | 30/261 |
| 2,074,239 | 3/1937 | Rush | 30/312 |
| 2,881,696 | 4/1959 | Poth | 81/417 |

*Primary Examiner*—James L. Jones, Jr.

*Attorney, Agent, or Firm*—Watson, Leavenworth, Kelton & Taggart

[57] ABSTRACT

Pliers in which a spring which moves the pliers handles apart is carried in a recess in one handle, and has a free end sliding in a guiding track in the other handle and which free end moves away from the point of the handles when the same are moved together.

3 Claims, 6 Drawing Figures

PLIERS

Figure 1:
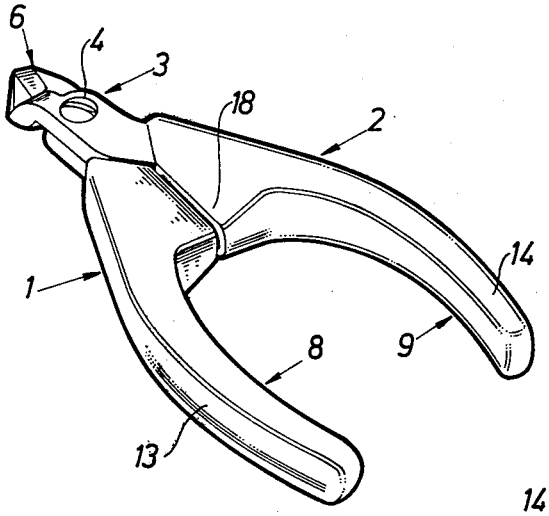

The invention relates to pliers with two limbs pivotally united in a joint and with a spring which, to move the handles of the limbs apart, is arranged between them and has an end part attached in a recess in the handle of one limb, and a free end part which, when the handles are moved towards each other against the spring bias, engages glidingly in a trough-like guiding track on the handle of the second limb, the track being open to the first limb, the free end part being so orientated that its place of engagement against the guiding track, during the movement of the handles towards each other, is moved in a direction away from the joint of the pliers.

The requirements of the opening function of the pliers, determined by the spring, varies with the type and field of use of the pliers. The invention is primarily intended to solve problems present with relation to said function in so-called electronics pliers, i.e. pliers which are used in assembly work in industrial production within the electronics industry and which are also used to a great extent for service work on the industrial products produced by this industry. Especially in the very ordinary use of side cutters, it is found that one and the same person makes thousands of nips per working day with the same pliers. In order to facilitate the work, it is then necessary that the spring in the pliers offers a distinct opening movement without causing too great an increase of the force required for bringing the limbs together. The conventional springing system of the pliers described in the introduction has not been able to be applied in electronics pliers, since the solutions available from such previously known pliers would require springs encroaching on the space on the inside of the handles. Taking into account the high frequency of use, the handle sleeves must offer a gentle and comfortable finger grip, and instead of the type of spring just mentioned there has been used, for example, a transversely placed helical compression spring between the limbs of the pliers immediately behind the joint portion so as to leave the handles of the electronics pliers free. The great demands on the function of the spring in combination with the high frequency of use makes it however desirable that, even with slight damage to the spring or signs of commenced fatique thereof, easily to be able to exchange the spring in the pliers, and this desire has not been able to be met with regard to the pliers equipped with helical springs.

The object of the invention is to provide pliers, the spring of which offers a distinct opening function, and is so placed that it leaves the handles free, while it is so arranged for easy exchange that the functional ability of the pliers is well provided for, and with the slightest fault in the spring function can be immediately regained by putting in a new spring.

The desired result is achieved by giving the pliers the characterizing features apparent from the following main claim.

Figure 2:
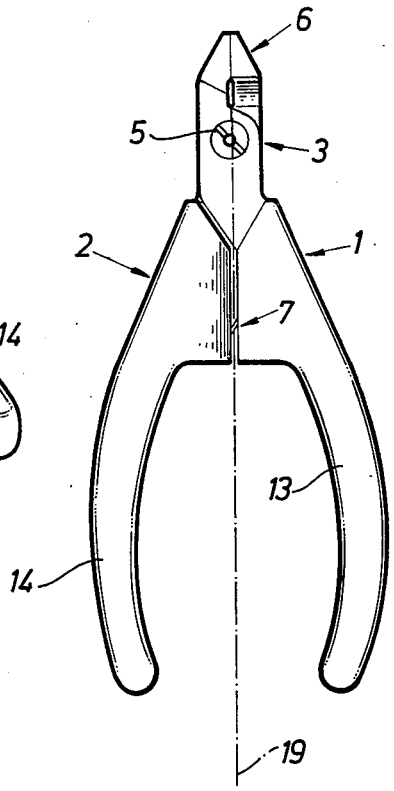
Figure 3:
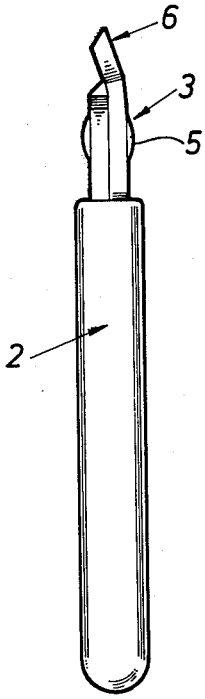
Figure 4:
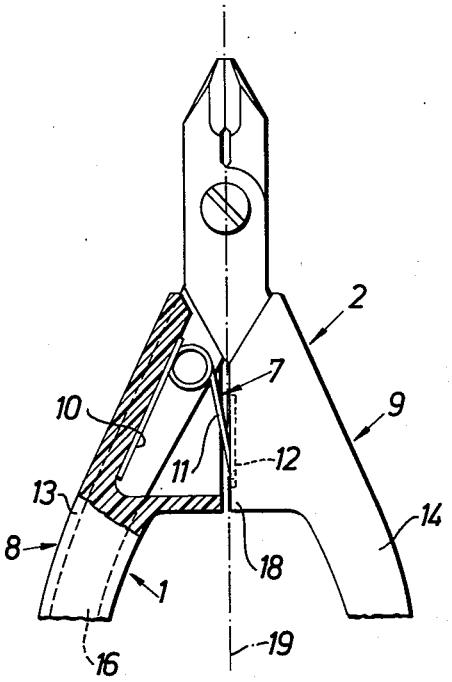
Figure 5:
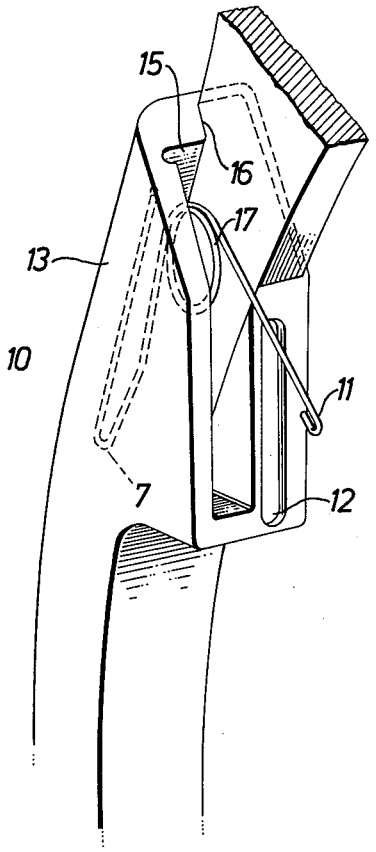
Figure 6:
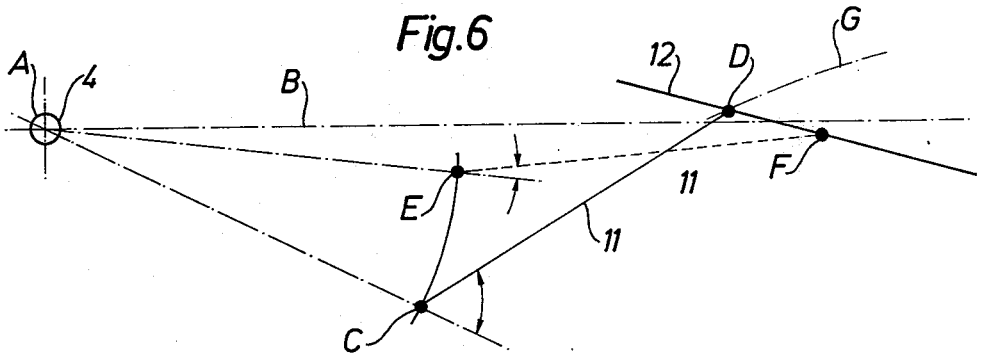

An embodiment of the invention will now be described more closely in the following while referring to the attached drawings where FIG. 1 is a perspective view of the pliers seen from the front, FIG. 2 is a plan view of the rear side of the same pliers, FIG. 3 is a side view of the same pliers, FIG. 4 is a partly cut away partial view of the front of the pliers showing the position of the spring, FIG. 5 is a perspective detail view showing the attachment of the spring to a handle sleeve on one limb of the pliers, FIG. 6 illustrates schematically the coaction between the spring and a guiding track for its free end.

The pliers shown are side cutters and have two limbs 1 and 2 pivotably united in a so-called single joint 3. At this joint both the limbs are adjustably kept together by a joint screw 4 with a partly countersunk head and a partly countersunk centering nut 5, both with a screwdriver slot for assembly and setting.

The jaws 6 of the pliers are made with side-cutting edges.

A spring 7 (FIG. 4) is arranged to move the handles 8, 9 of the limbs 1, 2 apart, and is situated between the limbs, with an end part 10 attached to one limb 1 and an opposing free end part 11 which, when moving the handles sufficiently far in a direction towards each other to cut with the pliers, engages glidingly against a guiding track 12 on the second limb 2 while exercising increasing spring bias against it. The free end part 11 is so directed that its place of engagement against the guiding track 12, during the movement of the handles towards each other, is moved in a direction away from the joint 3 of the pliers.

The limbs 1 and 2 are provided with handle sleeves 13 and 14, made from plastic, for example, to provide a comfortable grip.

The end part 10 of the spring 7, attached to the first limb 1, is actually introduced into a recess 15 in the handle sleeve 13 sideways to the hole 16 in the sleeve intended for the steel handle core of the limb 1. The spring is made from round wire but its end part 10 has been given a profiled, i.e. non-round, cross-section by means of hairpin bending. The recess 15 has a slit for one hairpin leg on the end part 10, orientated in the longitudinal direction of the handle. The other hairpin leg of the end part 10 passes over via a helically wound loop 17 into the free end part 11 of the spring. The last-mentioned hairpin leg engages against a wall in the recess and against the steel core of the handle opposite to the said slot, while the spring loop 17 engages against another portion of the wall in which the slit is arranged, whereby the spring 7, as a result of the shape of the profile of end part 10 and the recess, is retained in the recess, partly as a result of the spring bias of the hairpin bend, and is furthermore safeguarded against twisting so that its free end projecting out of the recess 15, loaded or unloaded by the opposite limb 2, is safely localized to a predetermined plane substantially parallel to the main plane of the pliers. Even if both handles of the pliers are taken from a wide-open position to a closed jaw position, the outer end of the free end part 11 of the spring hereby meets the guiding track 12, causing the spring to come into action during the final period of the closing movement.

The guiding track 12 is arranged on a projection 18 (FIG. 4) facing the first limb 1, on the handle sleeve 14 of the second limb 2. The object with this placing on a projection is to enable such a form and orientation of the guiding track that it either substantially coincides with a line through the centre of the pliers joint, or at its intersection points with such lines has such a slope that it approaches the first limb with increasing distance from the pliers joint. Hereby the end portion 11 of the spring is given a large movement which can be selected when dimensioning the handle sleeves, quite independent of the desired slope for correct grip of the handles themselves. FIG. 6 shows schematically an example of a straight guiding track 12, having such slope that with increasing distance from the pliers joint it approaches the first limb (not shown). A line B is drawn through the joint centre A of the pliers and cuts the guiding track 12. The first limb of the pliers is situated below the guiding track and carries the spring in its handle sleeve, whereat the free end of the spring in a first position (full line) of the limbs can be assumed to turn about the point C on the first limb and is in gliding contact with the guiding track 12 at point D. When the handles of the pliers are moved together, the twisting centre of the spring is moved from point C to point E and the end of the spring glides along the guiding track to the point F. The spring compression substantially taken up by the spring loop 17 and determined by the alteration in slope between the end portion 11 and the limb 1, i.e. between the end portion 11 and the A-C and A-E, respectively, in both shown positions is obviously much greater than if the end part of the spring were to have followed the inner configuration of a handle as indicated by the line G.

The embodiment shown in FIG. 4 also has the linear guiding track 12, but so orientated that when the handles 8, 9 are moved together to an end position for the cutting movement of the pliers, it substantially coincides with the line through the pivoting centre of the pliers and which consitutets the symmetry line 19 of the pliers with relation to its handle sleeves 13, 14.

The free end part 11 of the spring 7 is substantially straight but at its outer end is bent to form a suitable engagement surface against the guiding track 12 consisting of a straight trough with a U-profile facing the opposing limb 1.

Both handle sleeves 13, 14 of the limbs are suitably identically alike and each have a guiding track 12 as well as a recess 15 for the spring attachment. The guiding track and recess are placed side by side in each handle sleeve in the direction of thickness of the pliers (see FIG. 5) and allow the spring 7 to be mounted in an arbitrarily selected handle sleeve, and furthermore that such a spring can be placed in each handle sleeve, if required by greater opening force than what can be provided with a single spring. The identically similar shape of the handle sleeves also enables, as is especially apparent from FIGS. 1 and 2, an enclosure of the spring which is advantageous for the appearance of the pliers.

The guiding track on the limb 2 for the free end of the spring does not need to be straight, but can be curved towards the first limb 1. It is also conceivable to make the spring from strip material with, or without, a hairpin bend at the attachment end. Neither in these nor in other respects is the invention thus limited to the embodiments shown, but can be varied within the scope of the following claim 1.

I claim:

1. Pliers with two limbs (1,2) pivotally united in a joint (3) and with a spring (7) which is arranged between them to move the handles (8,9) of the limbs apart, and has an end part (10) attached in a recess (15) in the handle (8) of one limb (1), and a free end part (11) which, when the handles (8,9) are moved towards each other against the spring bias, engages glidingly in an open trough-shaped guiding track (12) facing the first limb (1), on the handle (9) of the other limb (2), and is so orientated that its place of engagement against the guiding track (12), during the movement of the handles (8,9) towards each other, is moved in a direction away from the joint (3) of the pliers, characterized in that the recess (15) and the guiding track (12) are situated in handle sleeves (13,14) arranged on respective limbs (1,2), the handle sleeve (14) provided with the guiding track (12) having a projection (18) facing towards the opposing handle sleeve (13), the guiding track (12) extending along the face of the projection turned towards the handle sleeve (13).

2. Pliers as claimed in claim 1, characterized in that the handle sleeves (13,14) of both limbs (1,2) are identically alike, each consequently having the guiding track (12) as well as the recess (15), which are thereby arranged side by side on the projection (18) so that springs optionally may be fixed in each handle sleeve.

3. Pliers as claimed in claim 2, characterized in that the guiding track (12) on the respective handle sleeve (13,14) is substantially linear, and so situated along the said face of the projection (18), that when the handles (8,9) are moved together to an end position for the jaw movement of the pliers, the track substantially coincides with a line of symmetry, passing through the centre of the joint in the pliers, with relation to the handle sleeves (13,14).

* * * * *